US009835014B2

(12) United States Patent
Dai

(10) Patent No.: US 9,835,014 B2
(45) Date of Patent: Dec. 5, 2017

(54) COAXIAL PERFORATING CHARGE AND ITS PERFORATION METHOD FOR SELF-ELIMINATING COMPACTED ZONE

(71) Applicant: XI'AN RUITONG ENERGY TECHNOLOGY CO., LTD, Xi'an, Shaanxi (CN)

(72) Inventor: Peng Dai, Shaanxi (CN)

( * ) Notice: Subject to any disclaimer, the term of this patent is extended or adjusted under 35 U.S.C. 154(b) by 0 days.

(21) Appl. No.: 14/394,728

(22) PCT Filed: Apr. 27, 2013

(86) PCT No.: PCT/CN2013/074869
§ 371 (c)(1),
(2) Date: Oct. 15, 2014

(87) PCT Pub. No.: WO2014/172910
PCT Pub. Date: Oct. 30, 2014

(65) Prior Publication Data

US 2016/0186536 A1 Jun. 30, 2016

(51) Int. Cl.
*F24B 1/02* (2006.01)
*F42B 3/08* (2006.01)
(Continued)

(52) U.S. Cl.
CPC ..... *E21B 43/117* (2013.01); *E21B 43/263* (2013.01); *F42B 1/02* (2013.01); *F42B 3/08* (2013.01); *F42B 12/16* (2013.01)

(58) Field of Classification Search
CPC ..... E21B 43/116–43/1195; F42B 1/02; F42B 1/032; F42B 3/08; F42B 12/16; F42D 3/04; C06B 27/00; C06B 29/22
(Continued)

(56) References Cited

U.S. PATENT DOCUMENTS 4,915,754 A * 4/1990 Hightower, Jr. ..... F02K 9/24 149/19.4
2007/0251615 A1* 11/2007 Amtower, II ..... C06B 21/0025 149/37

(Continued)

FOREIGN PATENT DOCUMENTS

CN 201502367 * 9/2009 ..... E21B 43/116
CN 102865058 * 9/2012 ..... E21B 43/116

*Primary Examiner* — George S Gray
(74) *Attorney, Agent, or Firm* — Novick, Kim & Lee, PLLC; Allen Xue

(57) ABSTRACT

A coaxial perforating charge includes a shaped charge and a container having a fracture explosive pack inside. The container is coaxially provided at a front end of the shaped charge; the fracture explosive pack is a ring-shaped explosive pack formed by impregnating a fracture explosive for eliminating a compacted zone into the container; the fracture explosive pack is coaxially arranged with the shaped charge. The fracture explosive includes ammonium perchlorate, aluminum powder, additive, and dioctyl sebacate; the additive is hydroxyl-terminated polybutadiene (HTPB), or a mixture of HTPB, N,N'-diphenyl-p-phenylenediamine and toluene di-isocyanate. A perforation method thereof, for self-eliminating a compacted zone, includes steps of: running a jet perforating gun downward; perforating while self-eliminating a compacted zone. The charge and its perforation method are reasonably designed, convenient, safe, reliable, well performed, and able to perforate while self-eliminating the compacted zone, which effectively eliminates an impact on rock permeability of the compacted zone.

21 Claims, 3 Drawing Sheets

(51) Int. Cl.

| | |
|---|---|
| ***E21B 43/117*** | (2006.01) |
| ***F42B 12/16*** | (2006.01) |
| ***E21B 43/263*** | (2006.01) |
| ***F42B 1/02*** | (2006.01) |

(58) Field of Classification Search
USPC ..... 102/305–310; 89/1.15, 1.151; 166/297, 166/63; 175/4.5, 4.57, 4.6, 3.5
See application file for complete search history.

(56) References Cited

U.S. PATENT DOCUMENTS

| | | | | |
|---|---|---|---|---|
| 2013/0098681 | A1* | 4/2013 | Zhang | E21B 43/117<br>175/4.5 |
| 2013/0146287 | A1* | 6/2013 | Zhang | E21B 43/116<br>166/297 |
| 2013/0206385 | A1* | 8/2013 | Feng | E21B 43/117<br>166/55 |

* cited by examiner

COAXIAL PERFORATING CHARGE AND ITS PERFORATION METHOD FOR SELF-ELIMINATING COMPACTED ZONE

CROSS REFERENCE OF RELATED APPLICATION

This is a U.S. National Stage under 35 U.S.C 371 of the International Application PCT/CN2013/074869, filed Apr. 27, 2013.

BACKGROUND OF THE PRESENT INVENTION

Field of Invention

The present invention relates to an oil field perforation, and more particularly to a coaxial perforating charge and its perforation method for self-eliminating a compacted zone.

Description of Related Arts

Conventionally, during perforating and fracturing the oil well by the perforation fracture recombiner applied in the oil field, the recombinant explosive is detonated within the perforating gun and bursts the pressure-releasing holes which are pre-made in the perforating gun, so as to create a pressure within the well casing and further create a pressure on the stratum after the well pressure increased. Statistics indicate that the depth of the cement ring after the deep hole fracturing is around 800 mm, and the fracturing cracks are around 2500 mm; and calculations indicate that the energy of the perforation facture recombiner is mostly consumed within the well casing, which causes a big energy loss and an ordinary perforation and fracture performance. Besides, the perforation fracture recombiners widely adopted in the Chinese oil fields are usually equipped with the shaped charges. The shaped charge forms the perforated tunnel after perforation, but also induces a perforating compacted zone. The conventional jet perforation relies on the jet to squeeze and generate the holes, so it is inevitable to form the perforating compacted zone around the tunnel of the formed deep hole, which greatly decrease the permeability of the stratum. According to experiments, the mechanical property and the fluid flow performance of the rock within the compacted zone are damaged; the value of the permeability thereof remains only 10% of the original value. As a result, the compacted zone is the most important component of the perforation damage, and severely affects the oil well production capacity. The conventional shaped charge is unable to avoid the perforation compacted zone caused by the defect per se. The solution about the stratum perforating compacted zone is an international difficulty. It is an urge demand of the oil fields to eliminate the stratum perforating compacted zone.

SUMMARY OF THE PRESENT INVENTION

An object of the present invention is to provide a coaxial perforating charge which has a simple structure, a convenient manufacture and operation, a good operation performance, and an ability to perforate while self-eliminating a perforating compacted zone, so as to overcome the above defects of the prior arts.

Accordingly, in order to accomplish the above objects, the present invention provides a coaxial perforating charge which comprises a shaped charge and a container having a fracture explosive pack provided inside. The container is coaxially provided at a front end of the shaped charge. The fracture explosive pack is a ring-shaped explosive pack formed by impregnating a fracture explosive for eliminating a perforating compacted zone into the container. The fracture explosive pack is coaxially arranged with the shaped charge. The fracture explosive comprises ammonium perchlorate, aluminum powder, an additive and dioctyl sebacate which are mixed as (weight percentage): ammonium perchlorate 50%~70%, aluminum powder 10%~30%, the additive 10%~15% and dioctyl sebacate 3%~5%. The additive is hydroxyl-terminated polybutadiene (HTPB), or a mixture of HTPB, N,N'-diphenyl-p-phenylenediamine and toluene diisocyanate (TDI) which are mixed by weight ratio as (2.85~7):(0.05~0.2):(3~7.8).

In the coaxial perforating charge, the fracture explosive pack provided inside the container has a weight of 20 g~40 g.

In the coaxial perforating charge, outer structure and size of the fracture explosive pack are correspondent to inner structure and size of a part of the container where the fracture explosive pack is arranged; a middle of the fracture explosive pack has a jet channel which is coaxially provided with the shaped charge; the front end of the container has a jet through-hole which is circular; the jet channel is intercommunicated with the jet through-hole, and the jet through-hole is arranged right in front of the jet channel.

In the coaxial perforating charge, a distance between a back end part of the fracture explosive pack and a front end part of the shaped charge is 10 mm~20 mm.

In the coaxial perforating charge, the jet channel is conical; a front end of the jet channel has a larger diameter than a back end thereof; and, the diameter of the front end of the jet channel is identical to a hole diameter of the jet through-hole.

In the coaxial perforating charge, the hole diameter of the jet through-hole is 10 mm~20 mm.

In the coaxial perforating charge, the diameter of the back end of the jet channel is 35 mm~45 mm.

In the coaxial perforating charge, the shaped charge comprises a charge case and a liner coaxially arranged within the charge case, wherein the charge case and the liner form a cavity therebetween, and a high explosive is loaded into the cavity; a middle of a back end of the charge case has a detonating semi-circle slot for holding a detonating cord; the detonating semi-circle slot is inter-communicated with an internal of the cavity through a detonating hole; and the jet channel is inter-communicated with an inner cavity of the liner.

In the coaxial perforating charge, the charge case is cylindrical; and the container is a cylindrical container or a bowl-shaped container.

In the coaxial perforating charge, an inner diameter of the cylindrical container is no less than an outer diameter of the charge case; an inner diameter of a back end of the bowl-shaped container is no less than the outer diameter of the charge case.

In the coaxial perforating charge, the container bonds with the front end of the shaped charge.

In the coaxial perforating charge, the container is made of steel and has a wall thickness of 2 mm~3 mm.

The present invention also provides a perforation method which is simple, convenient in operation, and capable of perforating while self-eliminating a perorating compacted zone, which forms perforated holes whose permeability reaches a stratum original permeability, comprising steps of:

(1) running a jet perforating gun downward, which comprises steps of: loading a plurality of the coaxial perforating charges into the jet perforating gun; running the loaded jet perforating gun downward into an oil and gas wellbore; and lowering the jet perforating gun to a preset perforating position; and (2) perforating while self-eliminating a compacted zone, which comprises steps of: activating the jet perforating gun which is located at the preset perforating position at step (1), and perforating via the coaxial perforating charges.

In the perforation method, during perforating of the step (2), when the coaxial perforating charge is shot by the jet perforating gun, the coaxial perforating charge generates a jet and enters the stratum, so as to form a perforated holebore of a compacted zone in the stratum; in the meantime, the fracture explosive pack provided at a front end of the coaxial perforating charge is coaxially fed into the perforated holebore along with the jet. With the fracture explosive gathering inside the perforated holebore, under a combined influence of a pressure and a temperature within the perforated holebore, a plurality of sympathetic explosions are subsequently induced within the perforated holebore, which generate cracks around the perforated holebore and completely communicates the perforated holebore with the stratum around the perforated holebore, so as to self-eliminate the compacted zone.

In the perforation method, in the step (1), a gun barrel of the jet perforating gun has an outer diameter D=89 mm~128 mm.

Compared with the prior arts, the present invention has following advantages.

(1) The coaxial perforating charge of the present invention has a simple structure, a reliable installing, convenient manufacture and operation, a good operation performance, a low accident possibility, and an ability to perforate while self-eliminating a perforating compacted zone.

(2) The fracture explosive of the present invention has reasonably designed components. A first explosion of the perforating charge, specifically as the high explosive of the shaped charge, has an explosion pressure of 10 GPa~40 GPa, and generates a jet at a jet speed of 7,000 m/s~10,000 m/s; at 40 μs~70 μs after the first explosion, the fracture explosive coaxially enters a perforated tunnel along with the jet at a speed of 3,500 m/s~5,000 m/s; during 70 μs~800 μs after the first explosion, the fracture explosive gradually gathers. When a concentration of the gathered fracture explosive reaches a certain level, the sympathetic explosion automatically emerges within the perforated tunnel, so as to accomplish fracturing the compacted zone. In practice, the weight percentage of each component of the fracture explosive can be adjusted based on specific demands.

(3) The perforation method of the present invention is simple and easy as the common perforation method. In the step of perforating of the present invention, the fracture explosive enters the perforated holebore coaxially with the jet of the shaped charge, and causes the plurality of the sympathetic explosions after the first explosion. In practical usage, the weight percentage of each component and a total dose of the fracture explosive can be adjusted to control a detonation time and a detonation condition of the fracture explosive; most of the fracture explosive enters the perforated tunnel via a rarefaction wave of the jet, then the entered fracture explosive subsequently explodes several times in the perforated holebore via the sympathetic explosions, which directly works within the perforated tunnel, so as to eliminate the compacted zone and form cracks favorable to an oil reservoir. In other words, in the present invention, according to a principle of multiple explosions, via the jet and pressure generated by the shaped charge, the fracture explosive is carried into the perforated holebore and then directly explodes in the holebore, so as to eliminate the compacted zone, generate the cracks, and recover, even improve, the stratum permeability.

(4) The present invention has a good operation performance, save labor and time, and a convenient implementation; the present invention is able to perforate while self-eliminating the perforating compacted zone. After the perforating is finished, within the perforated tunnel except an invaded zone, the permeability at some position can reach the original permeability of the stratum. The present invention effectively eliminates the impact on the stratum permeability brought by the compacted zone, and directly improves an oil production of oil wells.

(5) The present invention has a wide application field, and is suitable for perforating new and old ones of oil wells, gas wells or injection wells at various strata, especially suitable for an operation at a high density and low permeability strata.

Therefore, the present invention has the reasonable design, the convenient, safe and reliable operation, the good operation performance, and the ability to perforate while self-eliminating the perforating compacted zone, so as to effectively eliminate the impact on the stratum permeability caused by the compacted zone.

These and other objectives, features, and advantages of the present invention will become apparent from the following detailed description, the accompanying drawings, and the appended claims.

1-1: charge case; 1-2: liner; 1-3: high explosive; 1-4: detonating semi-circle slot; 1-5: detonating hole; 2: fracture explosive pack; 3: container; 4: jet through-hole; 5: jet channel.

DETAILED DESCRIPTION OF THE PREFERRED EMBODIMENT

First Preferred Embodiment

Figure 1:
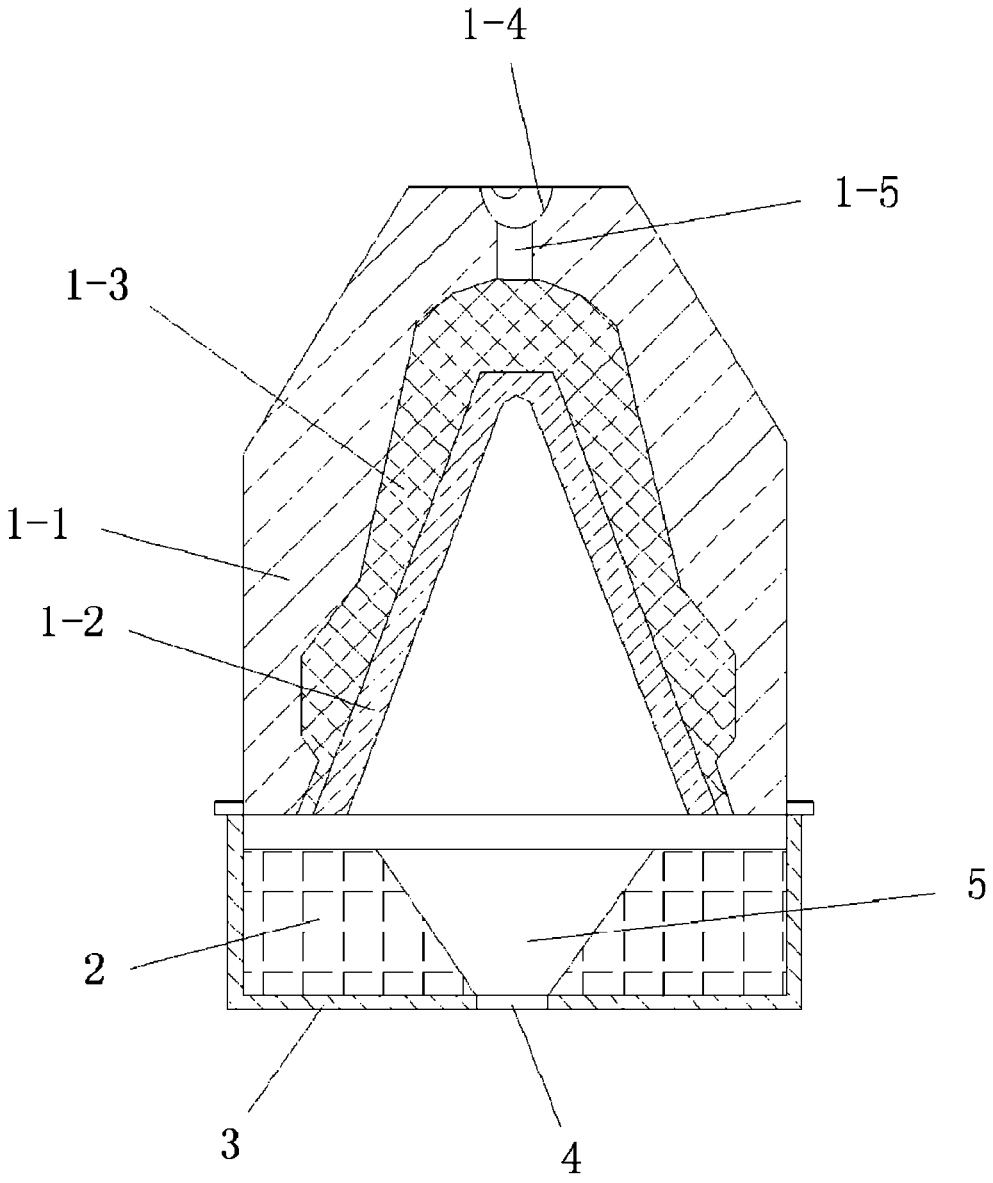
FIG. 1 is a sectional view of a coaxial perforating charge according to a first preferred embodiment of the present invention.

Referring to FIG. 1 of the drawings, according to a first preferred embodiment of the present invention, a coaxial perforating charge comprises a shaped charge 1 and a container 3 having a fracture explosive pack 2 provided inside. The container 3 is coaxially provided at a front end of the shaped charge 1. The fracture explosive pack 2 is a ring-shaped explosive pack formed by impregnating a fracture explosive for eliminating a perforating compacted zone into the container 3. The fracture explosive pack 2 is coaxially arranged with the shape charge 1. The fracture explosive comprises ammonium perchlorate, aluminum powder, an additive and dioctyl sebacate which are mixed as (weight percentage): ammonium perchlorate 50%~70%, aluminum powder 10%~30%, the additive 10%~15%, and dioctyl sebacate 3%~5%. The additive is hydroxyl-terminated polybutadiene (HTPB), or a mixture of HTPB, N,N'-diphenyl-p-phenylenediamine and toluene di-isocyanate (TDI) which are mixed by weight ratio as (2.85~7):(0.05~0.2):(3~7.8).

In the first preferred embodiment of the present invention, the fracture explosive comprises ammonium perchlorate 50%, aluminum powder 30%, the additive 15%, and dioctyl sebacate 5%; the additive is HTPB. In practice, the weight percentage of each component of the fracture explosive can be varied according to specific demands.

The container 3 is loaded with the fracture explosive pack 2 weighing 20 g~40 g.

In the first preferred embodiment of the present invention, the container 3 is loaded with the fracture explosive pack 2 weighing 30 g.

In the first preferred embodiment of the present invention, outer structure and size of the fracture explosive pack 2 are correspondent to inner structure and size of a part of the container 3 where the fracture explosive pack 2 is arranged; a middle of the fracture explosive pack 2 has a jet channel 5 which is coaxially provided with the shaped charge 1; the front end of the container 3 has a jet through-hole 4 which is circular; the jet channel 5 is inter-communicated with the jet through-hole 4, and the jet through-hole 4 is arranged right in front of the jet channel 5.

A distance between a back end part of the fracture explosive pack 2 and a front end part of the shaped charge 1 is 10 mm~20 mm.

In the first preferred embodiment of the present invention, the jet channel 5 is conical; a front end of the jet channel 5 has a larger diameter than a back end thereof; and, the diameter of the front end of the jet channel 5 is identical to a hole diameter of the jet through-hole 4.

The hole diameter of the jet through-hole 4 is 10 mm~20 mm; the diameter of the back end of the jet channel 5 is 35 mm~45 mm.

In the first preferred embodiment of the present invention, the distance between the back end part of the fracture explosive pack 2 and the front end part of the shaped charge 1 is 15 mm; the hole diameter of the jet through-hole 4 is 15 mm; and the diameter of the back end of the jet channel 5 is 40 mm. In practice, the distance, the hole diameter of the jet through-hole 4 and the diameter of the back end of the jet channel 5 can be varied according to specific demands.

In the first preferred embodiment of the present invention, the shaped charge 1 comprises a charge case 1-1, and a liner 1-2 coaxially provided within the charge case 1-1. The charge case 1-1 and the liner 1-2 form a cavity therebetween; and a high explosive 1-3 is filled into the cavity. A middle of a back end of the charge case 1-1 has a detonating semi-circle slot 1-4 for holding a detonating cord. The detonating semi-circle slot 1-4 is inter-communicated with an internal of the cavity through a detonating hole 1-5. The jet channel 5 is inter-communicated with an inner cavity of the liner 1-2.

Furthermore, a fixer for mounting the detonating cord is provided at an external wall of the back end of the charge case 1-1.

The shaped charge 1 has an outer diameter at a range of Φ34 mm~Φ52 mm. In practice, the shaped charge 1 is the conventional shaped charge adopted by the oil fields, such as DP33RDX-5, DP41RDX-1, DP44RDX-1, DP44RDX-3 and DP44RDX-5.

In the first preferred embodiment of the present invention, the fixer is a bent filament; the liner 1-2 is a conical lid; and the high explosive 1-3 is R852 explosive. The high explosive 1-3 can be embodied as other types of explosives in practice, such as SH-931 explosive and JH-16.

The charge case 1-1 is cylindrical; the container 3 is a cylindrical container or a bowl-shaped container. An inner diameter of the cylindrical container is no less than an outer diameter of the charge case 1-1; an inner diameter of a back end of the bowl-shaped container is no less than an outer diameter of the charge case 1-1.

In the first preferred embodiment of the present invention, the container 3 is the cylindrical container. The cylindrical container has a flat front end surface; and the inner diameter of the cylindrical container is identical to the outer diameter of the charge case 1-1.

The container 3 can also be embodied as the bowl-shaped container having a spherical front end surface.

In the first preferred embodiment of the present invention, the container 3 is made of steel and has a wall thickness of 2 mm~3 mm.

In the first preferred embodiment of the present invention, the container 3 is made of No. 20 steel of China's GB/JB standard, which is No. 1020 steel of U.S. AISI/SAE standard; and the charge case 1-1 is made of No. 45 steel of China's GB/JB standard, which is No. 1045 steel of U.S. AISI/SAE standard.

The container 3 can be made of other steel materials, such as carbon steel, in other embodiments.

In the first preferred embodiment of the present invention, the container 3 bonds with the front end of the shaped charge 1.

In practice, the container 3 can be mounted at the front end of the shaped charge 1 in other manners, such as by threads and by buckling.

The container 3 is bonded with the front end of the shaped charge 1 through metal bonding glue. A type of the metal bonding glue corresponds to materials of the container 3 and the charge case 1-1, as long as the container 3 bonds with the front end of the shaped charge 1. In the first preferred embodiment of the present invention, the metal bonding glue is metal epoxy glue or green red gum. The metal bonding glue can be embodied as other types of metal bonding glues in practice.

According to the present invention, a perforation method which involves the coaxial perforating charge to self-eliminate a compacted zone in a stratum comprises steps of:

(1) running a jet perforating gun downward, which comprises steps of: loading a plurality of the coaxial perforating charges into the jet perforating gun; running the loaded jet perforating gun downward into an oil and gas wellbore; and lowering the jet perforating gun to a preset perforating position; and (2) perforating while self-eliminating a compacted zone, which comprises steps of: activating the jet perforating gun which is located at the preset perforating position at step (1), and perforating via the coaxial perforating charges.

In the first preferred embodiment of the present invention, in the step (1), the jet perforating gun is lowered into the wellbore of the oil and gas well via a cable.

In the first preferred embodiment of the present invention, during perforating of the step (2), when the coaxial perforating charge is shot by the jet perforating gun, the coaxial perforating charge generates a jet and enters the stratum, so as to form a perforated holebore of a compacted zone in the stratum; in the meantime, the fracture explosive pack 2 provided at a front end of the coaxial perforating charge is coaxially fed into the perforated holebore along with the jet. With the fracture explosive gathering inside the perforated holebore, under a combined influence of a pressure and a temperature within the perforated holebore, a plurality of sympathetic explosions are subsequently induced within the perforated holebore, which generates cracks around the perforated holebore and completely communicates with the stratum around the perforated holebore, so as to self-eliminate the compacted zone.

A gun barrel of the jet perforating gun in the step (1) has an outer diameter D=89 mm~128 mm.

The jet perforating gun has an identical structure to a conventional perforating gun, such as YD-89, YD-102 and YD127. In the first preferred embodiment of the present invention, the gun barrel of the jet perforating gun in the step (1) has the outer diameter D=108 mm. The outer diameter of the gun barrel of the jet perforating gun can be varied based on specific demands in practical usage.

In the first preferred embodiment of the present invention, during perforating in the step (2), the detonating cord is firstly ignited, and then the ignited detonating cord strikes through an end wall between the detonating semi-circular slot 1-4 and the detonating hole 1-5, in such a manner that the high explosive 1-3 explodes and generates a high-speed jet which penetrates through a casing and a cement ring into the stratum, so as to form a perforated tunnel (i.e., the perforated holebore). After the high explosive 1-3 is denoted, the fracture explosive pack 2 provided at the front end of coaxial perforating charge is coaxially fed into the perforated holebore along with the jet, which means that the fracture explosive pack 2 accomplishes a direction control and enters the perforated holebore with the jet, wherein the fracture explosive pack 2 is coaxially arranged with the jet. Under a recombined influence of a pressure and a temperature gathered inside the perforated holebore, the fracture explosive pack 2 automatically induces a plurality of sympathetic explosions one after another, and accordingly eliminates a compacted zone in the perforated wellbore. Specifically speaking, the fracture explosive pack 2 detonates and fractures the compacted zone around the perforated holebore. After the perforating, permeability at each position within the perforated holebore reaches an original permeability of the strata, so as to accomplish self-eliminating the compacted zone.

According to a laboratory test about the permeability of rock core via microtomy, compared with a conventional shaped charge which is equivalent to the shaped charge 1 without the container 3 loaded with the fracture explosive pack 2, the coaxial perforating charge provided by the present invention has results of: a significantly larger diameter of the perforated holebore, larger than a conventional perforated holebore; a complete removal of an impact brought by the compacted zone; and a crack zone formed within the perforated holebore, so as to effectively eliminate the compacted zone caused by perforating and significantly improve the permeability of the perforated tunnel.

Moreover, in an in-situ perforating trial on several oil wells of some Chinese oil extracting factory, a conventional perforation method and the perforation method of the present invention for self-eliminating the compacted zone are compared and analyzed. The comparison and analysis results are as follows.

Figure 2:
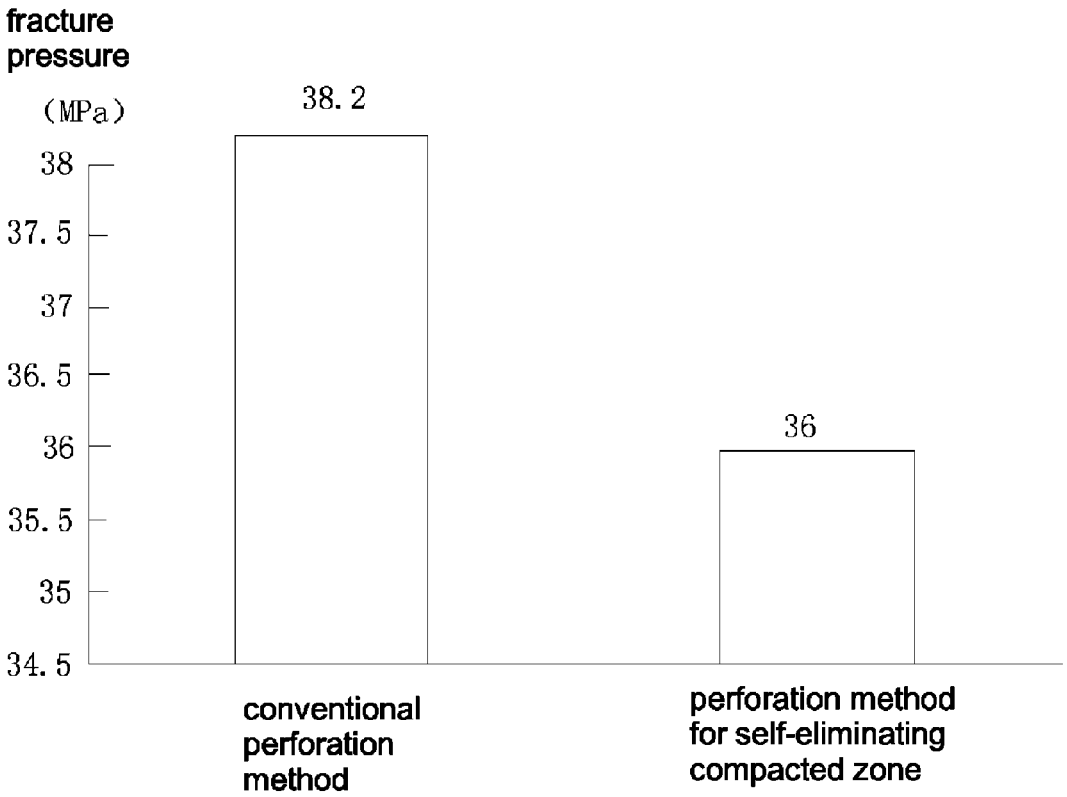
FIG. 2 is a comparison diagram of an average fracture pressure of a perforation method for self-eliminating a compacted zone according to the first preferred embodiment of the present invention and a conventional perforation method.

(1) fracture: an average fracture pressure generated by the perforation method for self-eliminating the compacted zone, according to the first preferred embodiment of the present invention, is lower than an average fracture pressure generated by the conventional perforation method by 2.2 MPa, as showed in FIG. 2.

Figure 3:
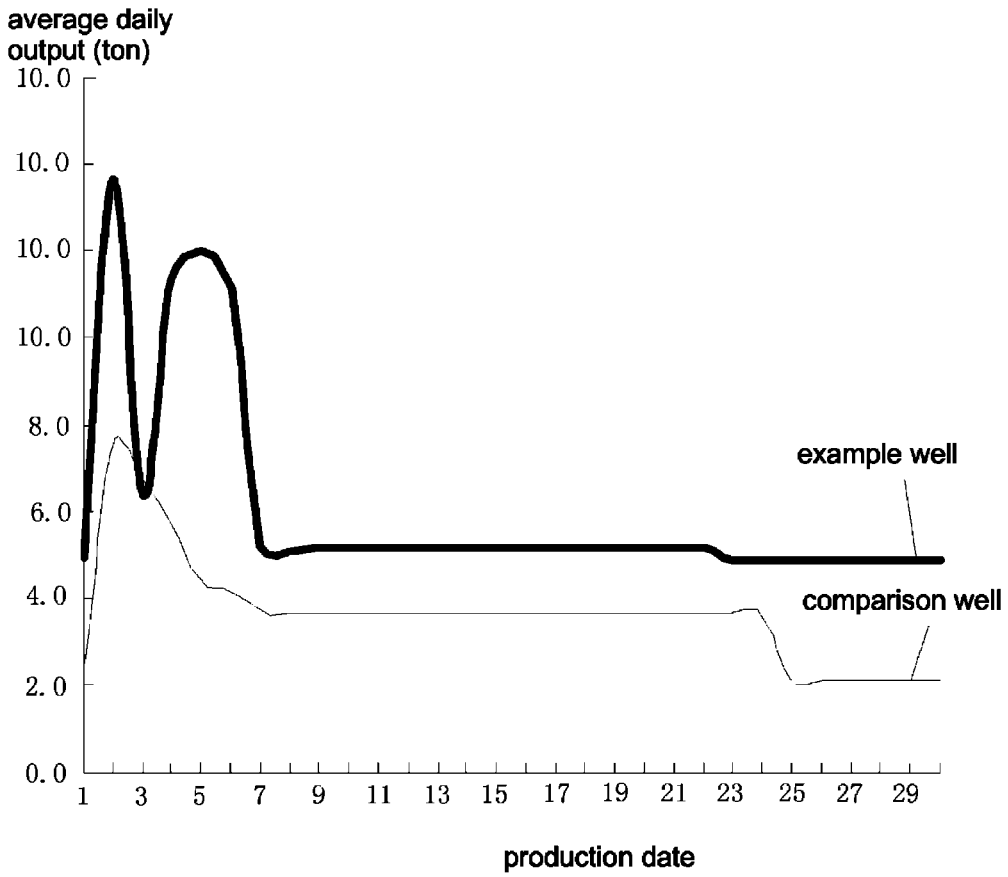
FIG. 3 is a comparison diagram of daily outputs in a primary month of two oil wells respectively applied with the perforation method according to the first preferred embodiment of the present invention and with the conventional perforation method.

(2) output: FIG. 3 shows a comparison result about daily outputs in a primary month of oil wells respectively applied with the perforation method for self-eliminating the compacted zone, according to the first preferred embodiment of the present invention, and with the conventional perforation method.

As showed in FIG. 3, the oil well applied with the perforation method of the present invention (the example well for short) has a higher primary output than the oil well applied with the conventional perforation method (the comparison well for short). The example well has an average daily output of 9.2 tons in first 7 days, while the comparison well has an average daily output of 4.9 tons in the first 7 days. In the first 7 days, the average daily output of the example well is higher than the average daily output of the comparison well by 4.3 tons; the output is increased more than 87%.

In the meantime, the example well has a longer stable production period which is 8 days~25 days; the example well has an average daily output of 5.1 tons, while the comparison well has an average daily output of 3.6 tons. The average daily output of the example well is higher than the average daily output of the comparison well by 1.5 tons. After 25 days, the example well has an average daily output of 4.9 tons, while the comparison well has an average daily output of 2.1 tons; the average daily output of the example well is higher than the average daily output of the comparison well by 2.8 tons, and the output is increased by 130%.

Conclusions about the in-situ perforation trial are as follows.

Firstly, the perforation method according to the first preferred embodiment is safe and reliable. An in-situ operation for the perforation of the present invention is identical to the perforating by the conventional shaped charge, and thus convenient. The perforating operation of the present invention is identical to the conventional perforating, and brings no damage to the casing or a perforator.

Secondly, the average fracture pressure during fracturing of the perforation method for self-eliminating the compacted zone, according to the present invention, is lower than the average fracture pressure of the conventional perforation, which means that a connection performance of rock is improved while a resistance of the rock is weakened, indirectly indicating that side effects of the compacted zone is reduced.

Thirdly, the present invention increases the output significantly.

Second Preferred Embodiment

A second preferred embodiment of the coaxial perforating charge differs from the first preferred embodiment in that: the explosive comprises ammonium perchlorate 70%, aluminum powder 10%, the additive 15% and dioctyl sebacate 5%; the additive is HTPB; the fracture explosive is 20 g; the distance between the back end part of the fracture explosive pack 2 and the front end part of the shaped charge 1 is 10 mm; the hole diameter of the jet through-hole 4 is 10 mm; and the diameter of the back end of the jet channel 5 is 35 mm.

The coaxial perforating charge according to the second preferred embodiment has a structure and connections as illustrated in the first preferred embodiment.

The perforation method for self-eliminating the compacted zone according to the second preferred embodiment differs from the first preferred embodiment in that: the outer diameter of the gun barrel of the jet perforating gun in the step (1) D=89 mm.

The perforation method according to the second preferred embodiment has rest details as illustrated in the first preferred embodiment.

Third Preferred Embodiment

A third preferred embodiment of the coaxial perforating charge differs from the first preferred embodiment in that: the explosive comprises ammonium perchlorate 65%, aluminum powder 22%, the additive 10% and dioctyl sebacate 3%; the additive is HTPB; the fracture explosive is 25 g; the distance between the back end part of the fracture explosive pack 2 and the front end part of the shaped charge 1 is 18 mm; the hole diameter of the jet through-hole 4 is 13 mm; and the diameter of the back end of the jet channel 5 is 42 mm.

The coaxial perforating charge according to the third preferred embodiment has a structure and connections as illustrated in the first preferred embodiment.

The perforation method for self-eliminating the compacted zone according to the third preferred embodiment differs from the first preferred embodiment in that: the outer diameter of the gun barrel of the jet perforating gun in the step (1) D=128 mm.

The perforation method according to the third preferred embodiment has rest details as illustrated in the first preferred embodiment.

Fourth Preferred Embodiment

A fourth preferred embodiment of the coaxial perforating charge differs from the first preferred embodiment in that: the explosive comprises ammonium perchlorate 56%, aluminum powder 28%, the additive 12% and dioctyl sebacate 4%; the additive is HTPB; the fracture explosive is 35 g; the distance between the back end part of the fracture explosive pack 2 and the front end part of the shaped charge 1 is 12 mm; the hole diameter of the jet through-hole 4 is 18 mm; and the diameter of the back end of the jet channel 5 is 38 mm.

The coaxial perforating charge according to the fourth preferred embodiment has a structure and connections as illustrated in the first preferred embodiment.

The perforation method for self-eliminating the compacted zone according to the fourth preferred embodiment differs from the first preferred embodiment in that: the outer diameter of the gun barrel of the jet perforating gun in the step (1) D=95 mm.

The perforation method according to the fourth preferred embodiment has rest details as illustrated in the first preferred embodiment.

Fifth Preferred Embodiment

A fifth preferred embodiment of the coaxial perforating charge differs from the first preferred embodiment in that: the explosive comprises ammonium perchlorate 65%, aluminum powder 15%, the additive 15% and dioctyl sebacate 5%; the distance between the back end part of the fracture explosive pack 2 and the front end part of the shaped charge 1 is 20 mm; the hole diameter of the jet through-hole 4 is 20 mm; and the diameter of the back end of the jet channel 5 is 45 mm.

The coaxial perforating charge according to the fifth preferred embodiment has a structure and connections as illustrated in the first preferred embodiment.

The perforation method for self-eliminating the compacted zone according to the fifth preferred embodiment differs from the first preferred embodiment in that: the outer diameter of the gun barrel of the jet perforating gun in the step (1) D=102 mm.

The perforation method according to the fifth preferred embodiment has rest details as illustrated in the first preferred embodiment.

Sixth Preferred Embodiment

A sixth preferred embodiment of the coaxial perforating charge differs from the first preferred embodiment in that: the explosive comprises ammonium perchlorate 60%, aluminum powder 20%, the additive 15% and dioctyl sebacate 5%.

The coaxial perforating charge according to the sixth preferred embodiment has a structure and connections as illustrated in the first preferred embodiment.

The perforation method for self-eliminating the compacted zone according to the sixth preferred embodiment differs from the first preferred embodiment in that: the outer diameter of the gun barrel of the jet perforating gun in the step (1) D=89 mm.

The perforation method according to the sixth preferred embodiment has rest details as illustrated in the first preferred embodiment.

Seventh Preferred Embodiment

A seventh preferred embodiment of the coaxial perforating charge differs from the first preferred embodiment in that: the additive is a mixture of HTPB, N,N'-diphenyl-p-phenylenediamine and TDI which are mixed by weight ratio as 2.85:0.05:3.

The coaxial perforating charge according to the seventh preferred embodiment has a structure and connections as illustrated in the first preferred embodiment. The weight percentages of ammonium perchlorate, aluminum powder, the additive and dioctyl sebacate of the fracture explosive of the coaxial perforating charge according to the seventh preferred embodiment are identical to those according to the first preferred embodiment.

The perforation method according to the seventh preferred embodiment is identical to the perforation method according to the first preferred embodiment.

Eighth Preferred Embodiment

An eighth preferred embodiment of the coaxial perforating charge differs from the first preferred embodiment in that: the additive is a mixture of HTPB, N,N'-diphenyl-p-phenylenediamine and TDI which are mixed by weight ratio as 7:0.2:7.8.

The coaxial perforating charge according to the eighth preferred embodiment has a structure and connections as illustrated in the first preferred embodiment. The weight percentages of ammonium perchlorate, aluminum powder, the additive and dioctyl sebacate of the fracture explosive of the coaxial perforating charge according to the eighth preferred embodiment are identical to those according to the first preferred embodiment.

The perforation method according to the eighth preferred embodiment is identical to the perforation method according to the first preferred embodiment.

Ninth Preferred Embodiment

A ninth preferred embodiment of the coaxial perforating charge differs from the second preferred embodiment in that: the additive is a mixture of HTPB, N,N'-diphenyl-p-phenylenediamine and TDI which are mixed by weight ratio as 3.5:0.08:4.

The weight ratios of HTPB, N,N'-diphenyl-p-phenylenediamine and TDI can be varied according to specific demands during a practical preparation of the mixture.

The coaxial perforating charge according to the ninth preferred embodiment has a structure and connections as illustrated in the second preferred embodiment. The weight percentages of ammonium perchlorate, aluminum powder, the additive and dioctyl sebacate of the fracture explosive of the coaxial perforating charge according to the ninth preferred embodiment are identical to those according to the second preferred embodiment.

The perforation method according to the ninth preferred embodiment is identical to the perforation method according to the second preferred embodiment.

Tenth Preferred Embodiment

A tenth preferred embodiment of the coaxial perforating charge differs from the third preferred embodiment in that: the additive is a mixture of HTPB, N,N'-diphenyl-p-phenylenediamine and TDI which are mixed by weight ratio as 4.5:0.15:5.5.

The coaxial perforating charge according to the tenth preferred embodiment has a structure and connections as illustrated in the third preferred embodiment. The weight percentages of ammonium perchlorate, aluminum powder, the additive and dioctyl sebacate of the fracture explosive of the coaxial perforating charge according to the tenth preferred embodiment are identical to those according to the third preferred embodiment.

The perforation method according to the tenth preferred embodiment is identical to the perforation method according to the third preferred embodiment.

Eleventh Preferred Embodiment

An eleventh preferred embodiment of the coaxial perforating charge differs from the third preferred embodiment in that: the additive is a mixture of HTPB, N,N'-diphenyl-p-phenylenediamine and TDI which are mixed by weight ratio as 5.5:0.18:6.5.

The coaxial perforating charge according to the eleventh preferred embodiment has a structure and connections as illustrated in the third preferred embodiment. The weight percentages of ammonium perchlorate, aluminum powder, the additive and dioctyl sebacate of the fracture explosive of the coaxial perforating charge according to the eleventh preferred embodiment are identical to those according to the third preferred embodiment.

The perforation method according to the eleventh preferred embodiment is identical to the perforation method according to the third preferred embodiment.

Twelfth Preferred Embodiment

A twelfth preferred embodiment of the coaxial perforating charge differs from the fourth preferred embodiment in that: the additive is a mixture of HTPB, N,N'-diphenyl-p-phenylenediamine and TDI which are mixed by weight ratio as 6.5:0.1:7.

The coaxial perforating charge according to the twelfth preferred embodiment has a structure and connections as illustrated in the fourth preferred embodiment. The weight percentages of ammonium perchlorate, aluminum powder, the additive and dioctyl sebacate of the fracture explosive of the coaxial perforating charge according to the twelfth preferred embodiment are identical to those according to the fourth preferred embodiment.

The perforation method according to the twelfth preferred embodiment is identical to the perforation method according to the fourth preferred embodiment.

Thirteenth Preferred Embodiment

A thirteenth preferred embodiment of the coaxial perforating charge differs from the fifth preferred embodiment in that: the additive is a mixture of HTPB, N,N'-diphenyl-p-phenylenediamine and TDI which are mixed by weight ratio as 4:0.1:4.

The coaxial perforating charge according to the thirteenth preferred embodiment has a structure and connections as illustrated in the fifth preferred embodiment. The weight percentages of ammonium perchlorate, aluminum powder, the additive and dioctyl sebacate of the fracture explosive of the coaxial perforating charge according to the thirteenth preferred embodiment are identical to those according to the fifth preferred embodiment.

The perforation method according to the thirteenth preferred embodiment is identical to the perforation method according to the fifth preferred embodiment.

Fourteenth Preferred Embodiment

A fourteenth preferred embodiment of the coaxial perforating charge differs from the sixth preferred embodiment in that: the additive is a mixture of HTPB, N,N'-diphenyl-p-phenylenediamine and TDI which are mixed by weight ratio as 5:0.1:6.

The coaxial perforating charge according to the fourteenth preferred embodiment has a structure and connections as illustrated in the sixth preferred embodiment. The weight percentages of ammonium perchlorate, aluminum powder, the additive and dioctyl sebacate of the fracture explosive of the coaxial perforating charge according to the fourteenth preferred embodiment are identical to those according to the sixth preferred embodiment.

The perforation method according to the fourteenth preferred embodiment is identical to the perforation method according to the sixth preferred embodiment.

Fifteenth Preferred Embodiment

A fifteenth preferred embodiment of the coaxial perforating charge differs from the seventh preferred embodiment in that: the additive is a mixture of HTPB, N,N'-diphenyl-p-phenylenediamine and TDI which are mixed by weight ratio as 2.85:0.05:7.8.

The coaxial perforating charge according to the fifteenth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the fifteenth preferred embodiment are identical to those according to the seventh preferred embodiment.

The perforation method according to the fifteenth preferred embodiment is identical to the perforation method according to the seventh preferred embodiment.

Sixteenth Preferred Embodiment

A sixteenth preferred embodiment of the coaxial perforating charge differs from the seventh preferred embodiment in that: the additive is a mixture of HTPB, N,N'-diphenyl-p-phenylenediamine and TDI which are mixed by weight ratio as 2.85:0.2:3.

The coaxial perforating charge according to the sixteenth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the sixteenth preferred embodiment are identical to those according to the seventh preferred embodiment.

The perforation method according to the sixteenth preferred embodiment is identical to the perforation method according to the seventh preferred embodiment.

Seventeenth Preferred Embodiment

A seventeenth preferred embodiment of the coaxial perforating charge differs from the seventh preferred embodiment in that: the additive is a mixture of HTPB, N,N'-diphenyl-p-phenylenediamine and TDI which are mixed by weight ratio as 2.85:0.2:7.8.

The coaxial perforating charge according to the seventeenth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the seventeenth preferred embodiment are identical to those according to the seventh preferred embodiment.

The perforation method according to the seventeenth preferred embodiment is identical to the perforation method according to the seventh preferred embodiment.

Eighteenth Preferred Embodiment

An eighteenth preferred embodiment of the coaxial perforating charge differs from the seventh preferred embodiment in that: the additive is a mixture of HTPB, N,N'-diphenyl-p-phenylenediamine and TDI which are mixed by weight ratio as 7:0.05:3.

The coaxial perforating charge according to the eighteenth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the eighteenth preferred embodiment are identical to those according to the seventh preferred embodiment.

The perforation method according to the eighteenth preferred embodiment is identical to the perforation method according to the seventh preferred embodiment.

Nineteenth Preferred Embodiment

A nineteenth preferred embodiment of the coaxial perforating charge differs from the seventh preferred embodiment in that: the additive is a mixture of HTPB, N,N'-diphenyl-p-phenylenediamine and TDI which are mixed by weight ratio as 7:0.05:7.8.

The coaxial perforating charge according to the nineteenth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the nineteenth preferred embodiment are identical to those according to the seventh preferred embodiment.

The perforation method according to the nineteenth preferred embodiment is identical to the perforation method according to the seventh preferred embodiment.

Twentieth Preferred Embodiment

A twentieth preferred embodiment of the coaxial perforating charge differs from the seventh preferred embodiment in that: the additive is a mixture of HTPB, N,N'-diphenyl-p-phenylenediamine and TDI which are mixed by weight ratio as 7:0.2:3.

The coaxial perforating charge according to the twentieth preferred embodiment has a structure and connections as illustrated in the seventh preferred embodiment. The weight percentages of ammonium perchlorate, aluminum powder, the additive and dioctyl sebacate of the fracture explosive of the coaxial perforating charge according to the twentieth preferred embodiment are identical to those according to the seventh preferred embodiment.

The perforation method according to the twentieth preferred embodiment is identical to the perforation method according to the seventh preferred embodiment.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A coaxial perforating charge for perforating a stratum, comprising:

a shaped charge containing a high explosive and a container containing a single pack of a fracture explosive, wherein the container is coaxially provided at a front end of the shaped charge, the fracture explosive pack is annular in shape and is coaxially arranged with the shaped charge, wherein the fracture explosive is a uniform mixture that comprises ammonium perchlorate 50%-70%, aluminum powder 10%-30%, an additive 10%-15%, and dioctyl sebacate 3%-5%, wherein the additive is hydroxyl-terminated polybutadiene (HTPB), or a mixture of HTPB, N,N'-diphenyl-p-phenylenediamine, and toluene di-isocyanate mixed by a weight ratio of (2.85-7):(0.05-0.2):(3-7.8), and, wherein the coaxial perforating charge is configured so that the high explosive detonates in the shaped charge and shoots a iet into the stratum to form a perforation tunnel, and the fracture explosive enters the perforation tunnel and detonates in the perforation tunnel to create fractures in a compacted zone surrounding the perforation tunnel.

2. A method of perforating a stratum, comprising:

(1) loading a plurality of the coaxial perforating charges of claim 1 into a jet perforating gun; placing the loaded jet perforating gun to a preset perforating position; and (2) firing the jet perforating gun to perforate the stratum.

3. The perforation method of claim 2, wherein a gun barrel of the jet perforating gun of the step (1) has an outer diameter D=89 mm-128 mm.

4. The perforation method of claim 2, wherein, in step (2), the high explosive in the coaxial perforating charge is detonated whereby sending a jet into the stratum so as to form a perforation tunnel in the stratum and create a compacted zone surrounding the perforation tunnel;

wherein the fracture explosive disposed at the front end of the coaxial perforating charge enters the perforation tunnel along with the jet and detonates in the perforation tunnel, generating fractures in the compacted zone surrounding the perforation tunnel.

5. The perforation method of claim 4, wherein a gun barrel of the jet perforating gun of the step (1) has an outer diameter D=89 mm-128 mm.

6. The perforation method of claim 4, wherein the fracture explosive detonates a plurality of times along a length of the perforation tunnel.

7. The coaxial perforating charge of claim 1, wherein the container bonds with the front end of the shaped charge.

8. The coaxial perforating charge of claim 1, wherein the container is made of steel and has a wall thickness of 2 mm-3 mm.

9. The coaxial perforating charge of claim 1, wherein a distance between a back end part of the fracture explosive pack and a front end part of the shaped charge is 10 mm-20 mm.

10. The coaxial perforating charge of claim 1, wherein the fracture explosive pack within the container has a weight of 20 g-40 g.

11. The coaxial perforating charge of claim 10, wherein an outer structure and a size of the fracture explosive pack corresponds to an inner structure and a size of a part of the container where the fracture explosive pack is arranged, respectively; a middle of the fracture explosive pack has a jet channel coaxially arranged in the shaped charge; the front end of the container has a circular jet through-hole; the jet channel is aligned with the jet through-hole.

12. The coaxial perforating charge of claim 11, wherein the jet channel is conical in shape; a diameter of a front end of the jet channel is smaller than a diameter of a back end thereof; the diameter of the front end of the jet channel is identical to a hole diameter of the jet through-hole.

13. The coaxial perforating charge of claim 11, wherein the shaped charge comprises a charge case and a liner coaxially arranged within the charge case; the charge case and the liner form a cavity therebetween, and the high explosive is disposed in the cavity; a middle of a back end of the charge case has a detonating semi-circular slot for holding a detonating cord; the detonating semi-circular slot is inter-communicated with an internal of the cavity via a detonating hole; and the jet channel is inter-communicated with an inner cavity of the liner.

14. The coaxial perforating charge of claim 13, wherein the charge case is cylindrical; and the container is a cylindrical container or a bowl-shaped container.

15. The coaxial perforating charge of claim 14, wherein an inner diameter of the cylindrical container is no less than an outer diameter of the charge case; and an inner diameter of a back end of the bowl-shaped container is no less than the outer diameter of the charge case.

16. The coaxial perforating charge of claim 10, wherein a distance between a back end part of the fracture explosive pack and a front end part of the shaped charge is 10 mm-20 mm.

17. The coaxial perforating charge of claim 1, wherein an outer structure and a size of the fracture explosive pack corresponds to an inner structure and a size of a part of the container where the fracture explosive pack is arranged, respectively; a middle of the fracture explosive pack has a jet channel coaxially arranged in the shaped charge; the front end of the container has a circular jet through-hole; the jet channel is aligned with the jet through-hole.

18. The coaxial perforating charge of claim 17, wherein the jet channel is conical in shape; a diameter of a front end of the jet channel is smaller than a diameter of a back end thereof; the diameter of the front end of the jet channel is identical to a hole diameter of the jet through-hole.

19. The coaxial perforating charge of claim 18, wherein the hole diameter of the jet through-hole is 10 mm-20 mm.

20. The coaxial perforating charge of claim 19, wherein the diameter of the back end of the jet channel is 35 mm-45 mm.

21. The coaxial perforating charge of claim 17, wherein the shaped charge comprises a charge case and a liner coaxially arranged within the charge case; the charge case and the liner form a cavity therebetween, and the high explosive is disposed in the cavity; a middle of a back end of the charge case has a detonating semi-circular slot for holding a detonating cord; the detonating semi-circular slot is inter-communicated with an internal of the cavity via a detonating hole; and the jet channel is inter-communicated with an inner cavity of the liner.

* * * * *